US006632141B2

(12) United States Patent
Webb et al.

(10) Patent No.: US 6,632,141 B2
(45) Date of Patent: Oct. 14, 2003

(54) GAMING DEVICE HAVING AN OFFER AN ACCEPTANCE SELECTION BONUS SCHEME WITH A TERMINATOR AND AN ANTI-TERMINATOR

(75) Inventors: Bayard S. Webb, Reno, NV (US); Anthony J. Baerlocher, Reno, NV (US); Gregg J. Palmer, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/945,082

(22) Filed: Aug. 31, 2001

(65) Prior Publication Data

US 2003/0045344 A1 Mar. 6, 2003

(51) Int. Cl.[7] ..... A63F 9/22
(52) U.S. Cl. ..... 463/25; 463/20; 273/143 R
(58) Field of Search ..... 463/1, 25, 9–13, 463/16–21; 273/138.1, 138.2, 139, 143 R, 269; 283/903

(56) References Cited

U.S. PATENT DOCUMENTS

| | | | | |
|---|---|---|---|---|
| 4,448,419 A | | 5/1984 | Telnaes | |
| 4,582,324 A | | 4/1986 | Koza et al. | |
| 4,624,459 A | | 11/1986 | Kaufman | |
| 4,695,053 A | | 9/1987 | Vazquez, Jr. et al. | |
| 4,991,848 A | | 2/1991 | Greenwood et al. | |
| 5,033,744 A | * | 7/1991 | Bridgeman et al. | 273/143 R |
| 5,178,390 A | | 1/1993 | Okada | |
| 5,205,555 A | | 4/1993 | Hamano | |
| 5,342,047 A | | 8/1994 | Heidel et al. | |
| 5,456,465 A | * | 10/1995 | Durham | 273/138.1 |
| 5,524,888 A | | 6/1996 | Heidel | |
| 5,536,016 A | | 7/1996 | Thompson | |
| 5,542,669 A | | 8/1996 | Charron et al. | |
| 5,560,603 A | | 10/1996 | Seelig et al. | |
| 5,611,535 A | | 3/1997 | Tiberio | |
| 5,711,525 A | | 1/1998 | Breeding | |

(List continued on next page.)

FOREIGN PATENT DOCUMENTS

| | | |
|---|---|---|
| EP | 0874337 A1 | 10/1998 |
| EP | 0926645 A2 | 6/1999 |
| EP | 0944030 A2 | 9/1999 |
| EP | 0945837 A2 | 9/1999 |
| EP | 0981119 A2 | 2/2000 |
| EP | 0984408 A2 | 3/2000 |
| EP | 0984409 A2 | 3/2000 |
| WO | WO 9732285 | 9/1997 |
| WO | WO 00/12186 | 3/2000 |

OTHER PUBLICATIONS

Punch–a–Bunch/The Punch Board, http://gscentral.net/punch.htm, pp. 1–5 (1978).*

(List continued on next page.)

*Primary Examiner*—Mark Sager
*Assistant Examiner*—Steven Ashburn
(74) *Attorney, Agent, or Firm*—Bell, Boyd & Lloyd LLC

(57) ABSTRACT

The present invention provides a gaming device having an offer/acceptance type bonus game. One embodiment provides a plurality player selectable selections wherein each selection has an associated offer, anti-terminator or terminator. The gaming device enables the player to pick the selections. If a terminator is associated with the selection, the game ends unless the player has previously picked an anti-terminator associated with a selection. When the player picks an anti-terminator, the processor retains or accumulates the anti-terminator until a terminator is selected. The anti-terminator nullifies the effect of the terminator and allows the game to continue. The present invention accordingly provides a gaming device which includes the combination of an offer acceptance bonus scheme having at least one terminator and at least one anti-terminator.

36 Claims, 10 Drawing Sheets

U.S. PATENT DOCUMENTS

| | | | | |
|---|---|---|---|---|
| 5,769,716 | A | 6/1998 | Saffari et al. | |
| 5,772,509 | A | 6/1998 | Weiss | |
| 5,775,692 | A | 7/1998 | Watts et al. | |
| 5,788,573 | A | 8/1998 | Baerlocher et al. | |
| 5,823,874 | A | 10/1998 | Adams | |
| 5,833,538 | A | 11/1998 | Weiss | |
| 5,848,932 | A | 12/1998 | Adams | |
| 5,851,148 | A | 12/1998 | Brune et al. | |
| 5,873,781 | A | 2/1999 | Keane | |
| 5,882,261 | A | 3/1999 | Adams | |
| 5,902,184 | A | 5/1999 | Bennett et al. | |
| 5,911,418 | A | 6/1999 | Adams | |
| 5,935,002 | A * | 8/1999 | Falciglia | 273/143 R |
| 5,947,820 | A | 9/1999 | Morro et al. | |
| 5,951,397 | A | 9/1999 | Dickinson | |
| 5,964,463 | A | 10/1999 | Moore, Jr. | |
| 5,967,894 | A | 10/1999 | Kinoshita et al. | |
| 5,980,384 | A | 11/1999 | Barrie | |
| 5,984,781 | A | 11/1999 | Sunaga | |
| 5,997,400 | A | 12/1999 | Seelig et al. | |
| 5,997,401 | A | 12/1999 | Crawford | |
| 6,004,207 | A | 12/1999 | Wilson, Jr. et al. | |
| 6,015,346 | A | 1/2000 | Bennett | |
| 6,019,369 | A | 2/2000 | Nakagawa et al. | |
| 6,033,307 | A | 3/2000 | Vancura | |
| 6,056,642 | A | 5/2000 | Bennett | |
| 6,059,289 | A | 5/2000 | Vancura | |
| 6,059,658 | A | 5/2000 | Mangano et al. | |
| 6,062,980 | A | 5/2000 | Luciano | |
| 6,089,976 | A | 7/2000 | Schneider et al. | |
| 6,089,977 | A | 7/2000 | Bennett | |
| 6,089,978 | A | 7/2000 | Adams | |
| 6,093,102 | A | 7/2000 | Bennett | |
| 6,102,798 | A | 8/2000 | Bennett | |
| 6,120,031 | A | 9/2000 | Adams | |
| 6,126,541 | A | 10/2000 | Fuchs | |
| 6,126,542 | A | 10/2000 | Fier | |
| 6,142,873 | A | 11/2000 | Weiss et al. | |
| 6,142,874 | A | 11/2000 | Kodachi et al. | |
| 6,142,875 | A | 11/2000 | Kodachi et al. | |
| 6,146,273 | A | 11/2000 | Olsen | |
| 6,159,095 | A | 12/2000 | Frohm et al. | |
| 6,159,096 | A | 12/2000 | Yoseloff | |
| 6,159,097 | A | 12/2000 | Gura | |
| 6,159,098 | A | 12/2000 | Slomiany et al. | |
| 6,162,121 | A | 12/2000 | Morro et al. | |
| 6,168,520 | B1 | 1/2001 | Baerlocher et al. | |
| 6,168,523 | B1 | 1/2001 | Piechowiak et al. | |
| 6,173,955 | B1 | 1/2001 | Perrie et al. | |
| 6,174,233 | B1 | 1/2001 | Sunaga et al. | |
| 6,174,235 | B1 | 1/2001 | Walker et al. | |
| 6,190,254 | B1 | 2/2001 | Bennett | |
| 6,190,255 | B1 * | 2/2001 | Thomas et al. | 463/20 |
| 6,203,429 | B1 | 3/2001 | Demar et al. | |
| 6,210,279 | B1 | 4/2001 | Dickinson | |
| 6,213,876 | B1 | 4/2001 | Moore, Jr. | |
| 6,224,483 | B1 | 5/2001 | Mayeroff | |
| 6,231,442 | B1 | 5/2001 | Mayeroff | |
| 6,231,445 | B1 | 5/2001 | Acres | |
| 6,261,177 | B1 | 7/2001 | Bennett | |
| 6,302,790 | B1 | 10/2001 | Brossard | |
| 6,305,686 | B1 | 10/2001 | Perrie et al. | |
| 6,309,300 | B1 | 10/2001 | Glavich | |
| 6,328,649 | B1 | 12/2001 | Randall et al. | |
| 6,375,187 | B1 | 4/2002 | Baerlocher | |

OTHER PUBLICATIONS

Jackpot Party Brochures and Aricles written by WMS Gaming, Inc. published in 1998.

Monopoly Brochures and Articles written by WMS Gaming, Inc. published in 1998, 1999, 2000.

Top Dollar Brochure written by IGT published in 1999.

Addams Family Advertisement and Article written by IGT, Strictly Slots, published in 2000.

Adders and Ladders Advertisement written by Barcrest Ltd., published prior to 2000.

American Thunder Screen Slots written by IGT, published in 1998.

Big Bang Piggy Bankin Advertisement written by WMS Gaming, Inc., published prior to 2000.

Blackjack/Twenty–One Description written by Hoyle's Rules of Games, published in 1993.

Bonus Spin Red, White & Blue Advertisement written by IGT, published in 2000.

Bonus Times Article written by Strictly Slots, published in 2000.

By George written by IGT, published in 2002.

Carribbean Gold II Advertisement written by Aristocrat Incorporated, published in 1998.

Cash Box Advertisement & Article written by Anchor Games, Strictly Slots, published in 2000.

Chutes & Ladders Game Instructions written by Hasbro–Milton Bradley, published in 1999.

Description of Let's Make a Deal Television Show written by letsmakeadeal.com (2 pages), printed on Mar. 6, 2001.

Double Diamond Game Descriptions written by IGT printed on Mar. 21, 2001.

Double Up Poker Game Description written by IGT Undated.

Easy Street Advertisements and Articles written by Casino Data Systems, published in 2000.

Elvis Advertisement written by IGT, published in 1999.

Empire Game Advertisement written by AC Coin, published in 1996.

Fire and Fortune Article written by Strictly Slots, published in 2001.

Fox "N" Hound Advertisement written by IGT, published in 2000.

In Between Game Description written by IGT, available prior to 2000.

Keep Your Hat on Advertisement written by Aristocrat, published in 2001.

Let's Make a Deal written by geocities.com (10 pages), printed on Mar. 21, 2001.

Let's Make a Deal written by fortunecity.com (4 pages), printed on Mar. 21, 2001.

Let's Make a Deal written by Illinoislottery.com (1 page), printed on Mar. 21, 2001.

Let's Make a Deal geocities.com (2 pages), printed on Mar. 16, 2001.

Let's Make A Deal Advertisement written by Shuffle Master and IGT, published in 2001.

Let's Make a Deal Game Advertisement written by Bally Gaming Systems, published in 1999.

Little Green Men Advertisement and Article written by IGT, Strictly Slots, published in 2000.

MegaJackpots Advertisement written by IGT, published in 1998.

Money Grab Article written by Strictly Slots, published in Apr. 2001.

Money in the Bank Advertisement written by Strictly Slots Konami, published in 2001.

Monopoly Party Train Article written by Strictly Slots, published in 2002.
Neon Nights written by IGT, published in 2000.
On the Money Article written by Strictly Slots, Casino Data Systems, published in Dec. 2000.
Polly & Roger Advertisement written by VLC, Inc., published in 2000.
Price is Right "Cliff Hangers" Description written by www.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
Take Your Pick Aricle written by Strictly Slots, published in Mar. 2001.
Take Your Pick Advertisement written by IGT/Anchor Gaming, published in 1999.
Texas Tea Advertisement written by IGT, published in 2000.
The Deals of Let's Make a Deal written by fortunecity.com (2 pages), printed on Mar. 16, 2001.
The Official Let's Make a Deal Website written by Bally Gaming System Website, printed on Mar. 16, 2001.
Top Cat Advertisement written by WMS Gaming, Inc., published prior to 2000.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming Inc., published in 1998.

* cited by examiner

GAMING DEVICE HAVING AN OFFER AN ACCEPTANCE SELECTION BONUS SCHEME WITH A TERMINATOR AND AN ANTI-TERMINATOR

CROSS REFERENCE TO RELATED APPLICATIONS

This application is related to the following commonly-owned co-pending patent applications: "GAMING DEVICE HAVING SEPARATELY CHANGEABLE VALUE AND MODIFIER BONUS SCHEME," Ser. No. 09/626,045; "GAMING DEVICE HAVING A BONUS ROUND WITH MULTIPLE RANDOM AWARD GENERATION AND MULTIPLE RETURN/RISK SCENARIOS," Ser. No. 09/678,989; "GAMING DEVICE HAVING AN AWARD EXCHANGE BONUS ROUND AND METHOD FOR REVEALING AWARD EXCHANGE POSSIBILITIES," Ser. No. 09/689,510; "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601; "GAMING DEVICE HAVING A DESTINATION PURSUIT BONUS SCHEME WITH ADVANCED AND SETBACK CONDITIONS," Ser. No. 09/686,409, now U.S. Pat. No. 6,494,785; "GAMING DEVICE HAVING VALUE SELECTION BONUS," Ser. No. 09/684,605, now U.S. Pat. No. 6,514,141; "GAMING DEVICE HAVING RISK EVALUATION BONUS ROUND," Ser. No. 09/688,434, "GAMING DEVICE HAVING AN IMPROVED OFFER/ACCEPTANCE BONUS SCHEME," Ser. No. 09/966,884; "GAMING DEVICE HAVING IMPROVED OFFER AND ACCEPTANCE BONUS SCHEME," Ser. No. 09/680,630, now U.S. Pat. No. 6,373,137; "GAMING DEVICE HAVING IMPROVED AWARD OFFER BONUS SCHEME," Ser. No. 09/682,368, now U.S. Pat. No. 6,506,118; "GAMING DEVICE HAVING OFFER AND ACCEPTANCE GAME WITH HIDDEN OFFER," Ser. No. 10/160,688; "GAMING DEVICE HAVING OFFER ACCEPTANCE GAME WITH TERMINATION LIMIT," Ser. No. 09/822,711; "GAMING DEVICE HAVING OFFER/ACCEPTANCE ADVANCE THRESHOLD AND LIMIT BONUS SCHEME" Ser. No. 09/838,014; "GAMING DEVICE HAVING IMPROVED OFFER AND ACCEPTANCE GAME WITH MASKED OFFERS," Ser. No. 10/086,014; "GAMING DEVICE HAVING AN AWARD OFFER AND TERMINATION BONUS SCHEME," Ser. No. 09/682,428; "GAMING DEVICE HAVING AN OFFER AND ACCEPTANCE GAME WITH A PLAYER SELECTION FEATURE," Ser. No. 10/086,078; and "GAMING DEVICE HAVING

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having an offer and acceptance selection bonus scheme with a terminator and a multi-functional anti-terminator.

BACKGROUND OF THE INVENTION

Gaming devices, such as slot machines, having primary and secondary or bonus games or schemes are well known.

One well known bonus game provides a player with a series of award offers consisting of credits or dollars. The player may either accept each award offer or reject each award offer; however, the player must accept the final award offer. If the player accepts an award offer, the player keeps the award offered. If the player rejects the award offer, the gaming device provides another award offer to the player except if the award offer is the final award offer. The award offers are randomly determined from a series of award offers of differing values.

Other known gaming devices, such as the gaming device disclosed in European Patent No. EP 09454837A2 utilize terminators. In the gaming device disclosed therein, the gaming device provides a plurality of selections in a bonus game. The selections include masked or hidden awards and terminators. The player receives an award for each selection picked by the player that is not a terminator. The player continues to pick selections until the player obtains a terminator. The terminator ends the bonus game and the player receives the total of all the awards they obtained during the bonus game.

Other known gaming devices, such as the gaming device disclosed in U.S. Pat. No. 6,190,255 B1 utilize an anti-terminator. In the gaming device disclosed therein, upon a specific symbol combination in the basic mode, the gaming device generates an anti-terminator which is subsequently exercisable in a bonus game of the gaming device. Until the gaming device activates the bonus mode, the player may continue obtaining anti-terminators in the basic mode. In the bonus mode, a player may use an anti-terminator to override an otherwise undesired outcome of the bonus game. For example, if in the bonus mode the player obtained an outcome that would end the bonus mode, an anti-terminator, if available, may be used to override the end bonus mode outcome and thereby continue play of the bonus mode.

While this type of gaming device has achieved significant popularity in the gaming industry, after playing the game repeatedly, players may lose interest in the game. Furthermore, gaming devices having offer and acceptance games have not included a plurality of selections including terminators and anti-terminators in a bonus scheme. Accordingly, there is a need for a new gaming device having an offer and acceptance selection bonus scheme with a terminator and an anti-terminator.

SUMMARY OF THE INVENTION

The present invention provides a gaming device having an improved offer and acceptance bonus scheme. In one embodiment of the present invention, the gaming device provides a player a plurality of opportunities to pick from a plurality of selections. Each selection has an offer or symbol randomly associated with it. The offers may be randomly determined or arranged prior to or during the selection process from a pool of offers. The player picks one of the selections and the gaming device reveals the offer or symbol associated with that selection. If the player accepts the revealed offer, the player obtains the revealed offer and the bonus game ends. If the player does not accept the revealed offer, and the offer is not the final offer, the player may make another selection from the plurality of selections. If the player has not accepted any of the offers prior to the last possible offer, the gaming device provides the player with the last offer, which the player cannot reject.

A terminator or termination symbol is associated with at least one selection and an anti-terminator or anti-termination symbol is associated with at least one selection. If the player picks a selection that has a termination symbol associated with it, the bonus scheme ends. If a player obtains the termination symbol, the game will provide no award, provide the player the last rejected award, provide the player a consolation award or select another award to provide the player. If the player picks a selection that has an anti-termination symbol associated with it, the player retains the anti-termination symbol and picks another selection. If the player subsequently picks a selection that has a termination symbol associated with it, the retained anti-termination symbol nullifies the bonus scheme ending effect of the termination symbol. It should be appreciated that alternative embodiments can include multiple termination symbols, multiple anti-termination symbols and combinations thereof.

It is therefore an advantage of the present invention to provide a gaming device having an offer and acceptance selection bonus scheme with a terminator and an anti-terminator.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1A:
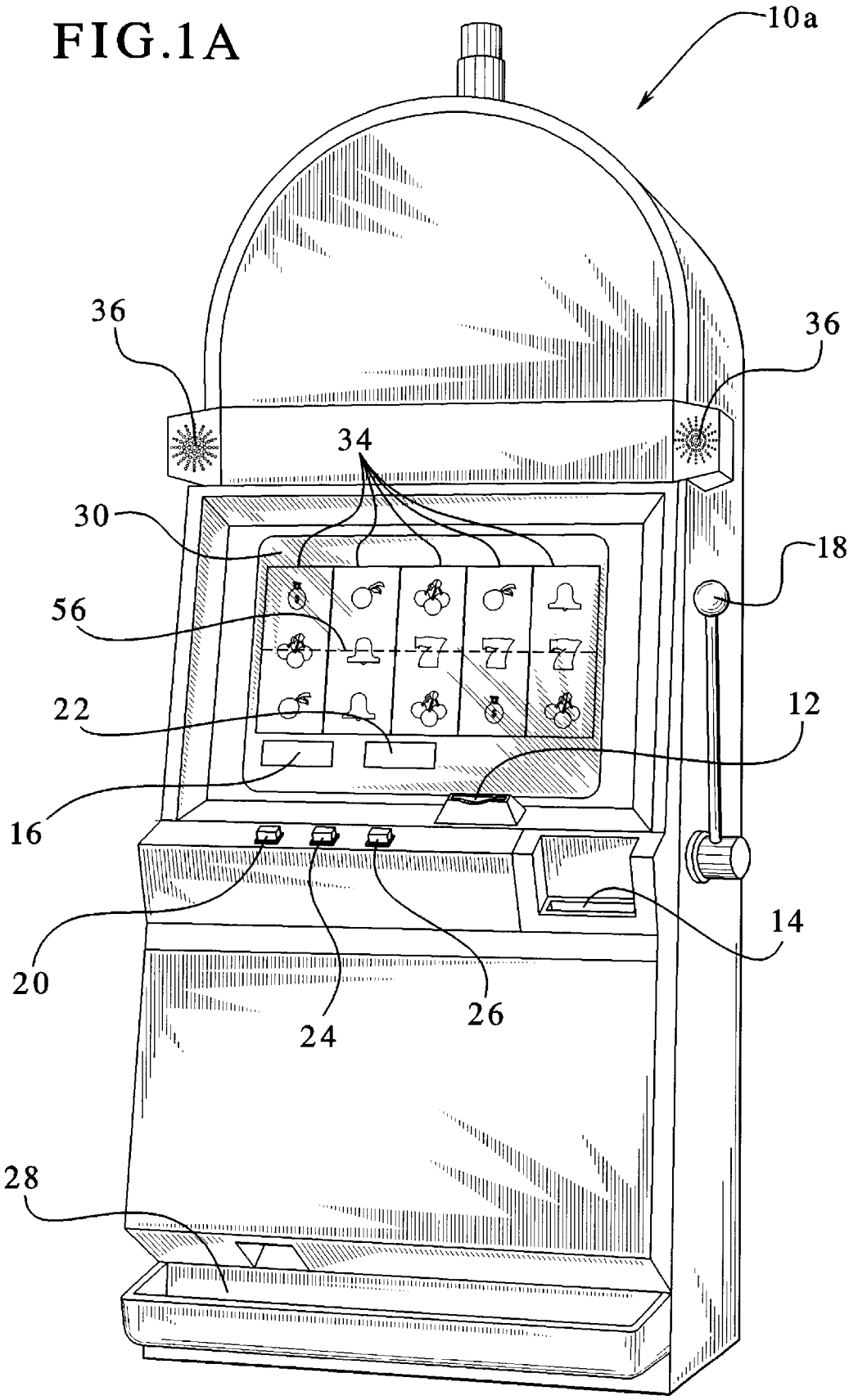
FIGS. 1A and 1B are perspective views of alternative embodiments of the gaming device of the present invention.
Figure 1B:
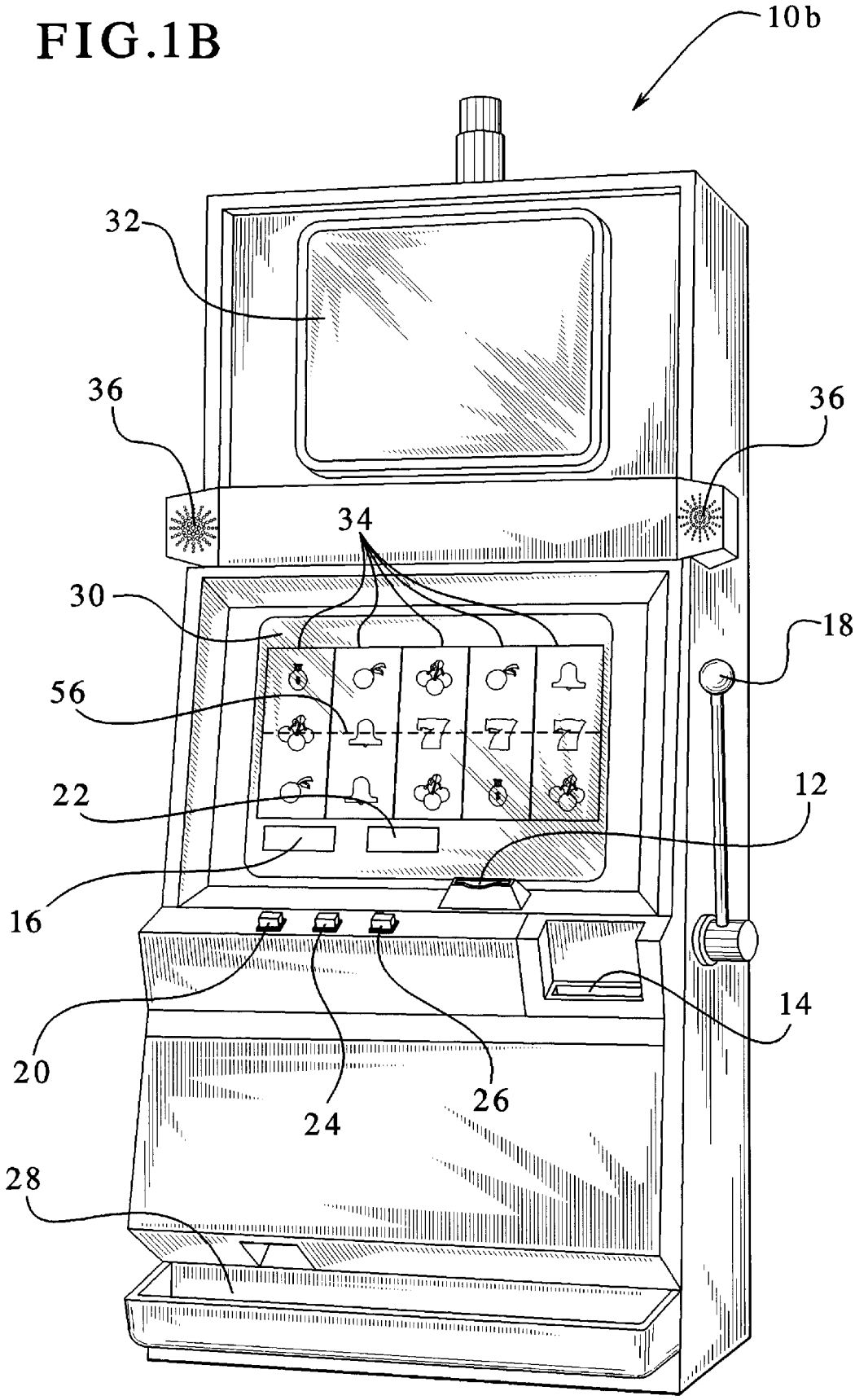

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
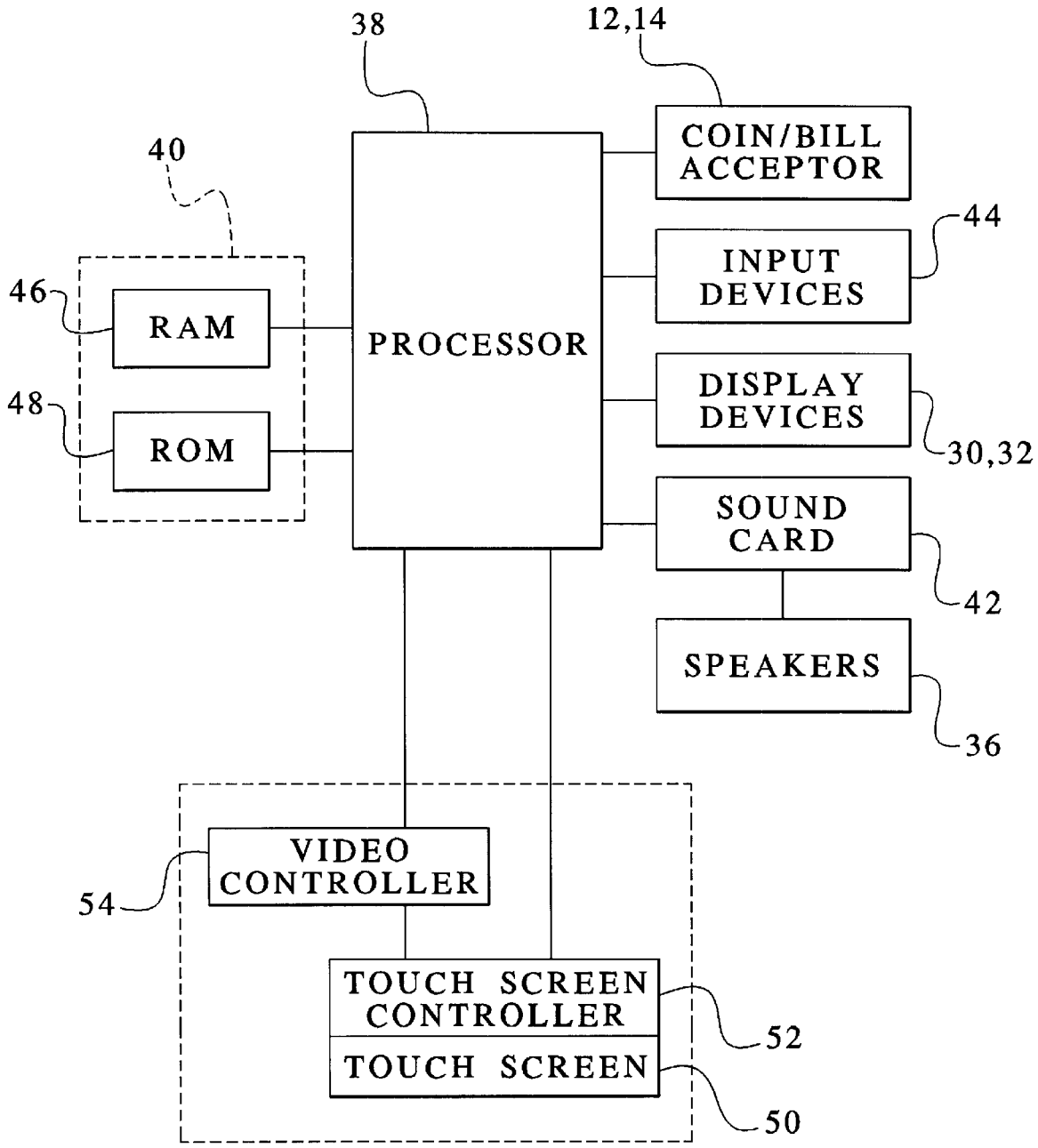
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As farther illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the computer or controller.

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines displayed in a horizontal and/or diagonal fashion.

Bonus Scheme

Figure 3A:
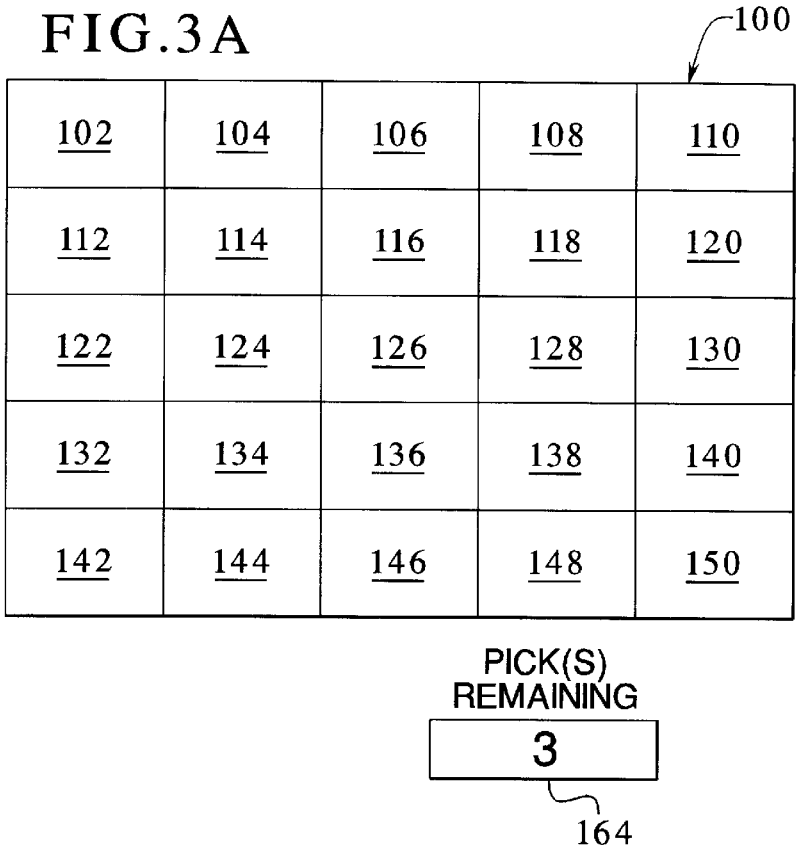
FIG. 3A is a front elevational view of the offer selection screen of one embodiment of the present invention illustrating a plurality of selections which the player can select to obtain an offer.

Referring now to FIG. 3A, one embodiment of the offer and acceptance selection bonus scheme of the present invention provides a screen or display 100 which is preferably a touch screen, which enables the player to make selections to obtain or to be offered the offers. The game preferably provides a plurality of selections on the screen or display which the player may choose from. The touch screen functions as a selector which enables the player to pick the selections. It should be appreciated that any other suitable device could be employed as a selector for enabling the player to select the selections. An offer, a termination symbol, or an anti-termination symbol is associated with each selection. The gaming device does not initially display the offer (such as a credit or dollar amount) or symbol associated with each selection.

In one embodiment, the offer or symbol associated with each selection is randomly determined each time the bonus scheme is triggered. In this embodiment, after an offer or symbol is associated with a selection, that association remains fixed for the duration of the bonus scheme. In an alternative embodiment, the offer or symbol associated with each selection is randomly determined prior to each time the player is allowed to pick a selection.

Figure 4A:
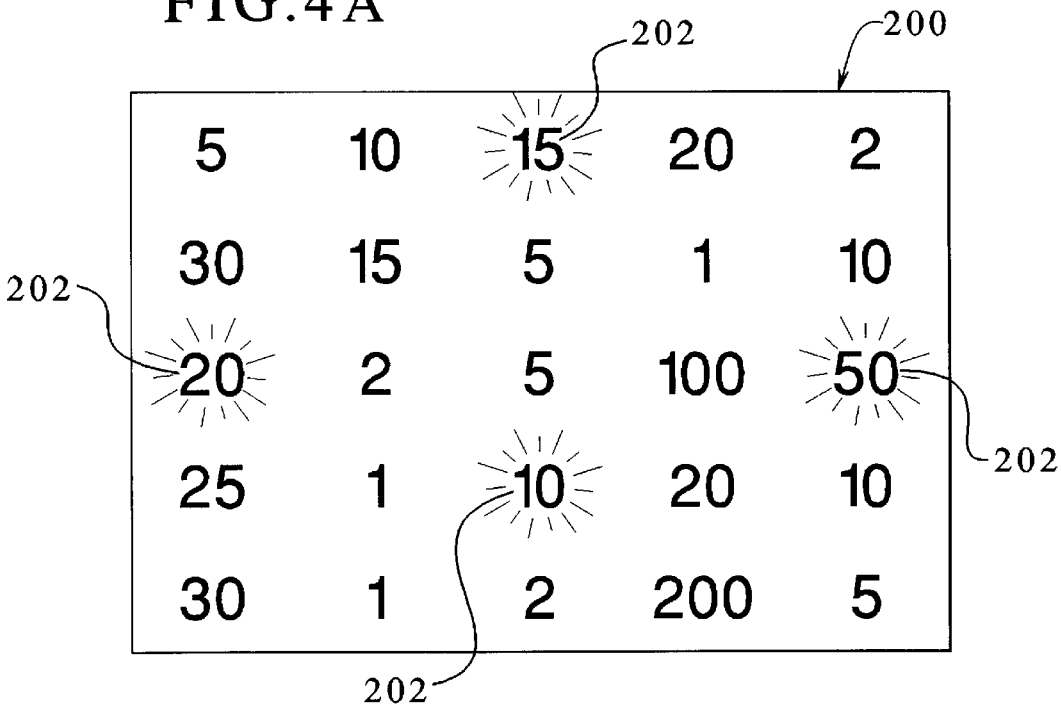
FIGS. 4A to 4C are tables which illustrate the gaming device selecting the offers to be associated with the player selectable selections of the present invention.
Figure 4B:
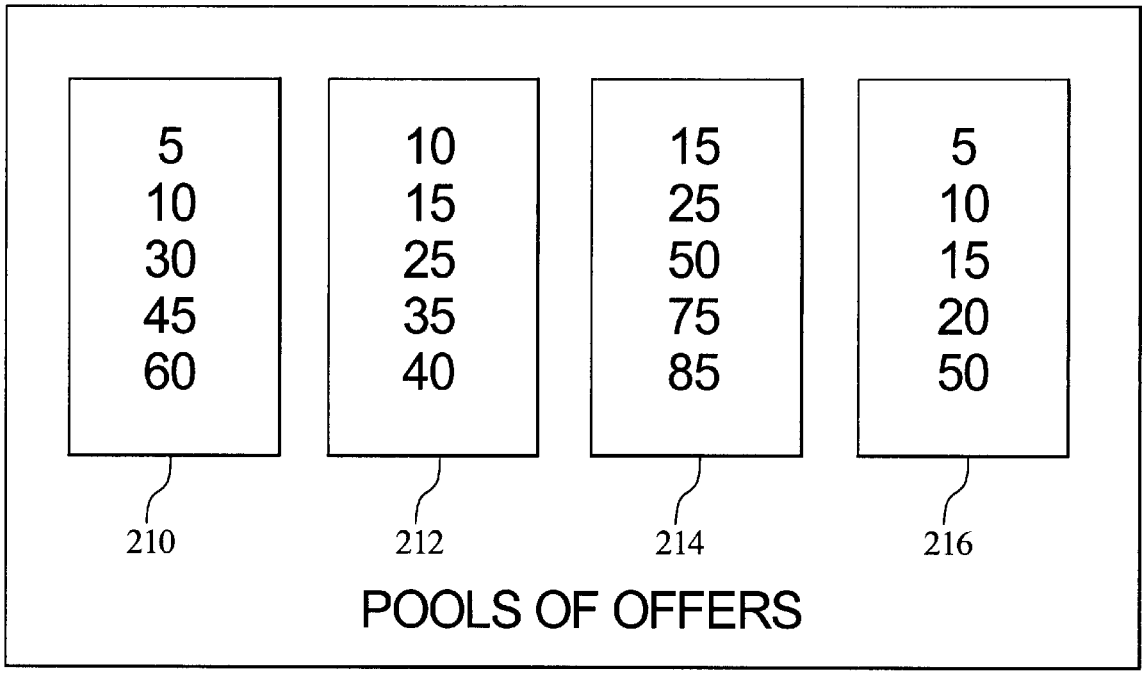
Figure 4C:
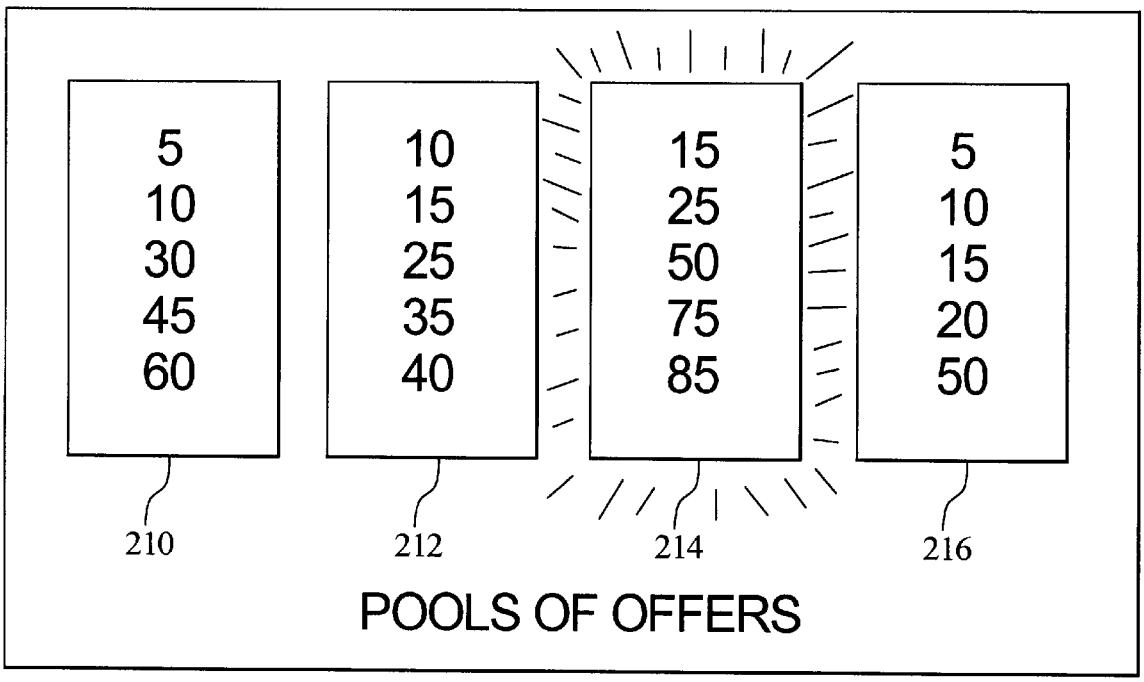

In one embodiment, the gaming device randomly selects the offers from a pre-determined pool of offers. For example, as illustrated in FIG. 4A upon the initiation of the bonus scheme, the gaming device selects a plurality of offers 202 from a predetermined pool of offers 200. In an alternative embodiment, the gaming device selects the offers from multiple pre-determined pools of offers. For example, as illustrated in FIGS. 4B and 4C, there are four pre-determined pools of offers 210, 212, 214 and 216. Upon the initiation of the bonus game, the gaming device selected the pre-determined pool of offers 214 with the award values of fifteen, twenty-five, fifty, seventy-five and eighty-five. In another alternative embodiment, the gaming device randomly selects offers from a pre-determined range of offer amounts. For example, as illustrated in FIG. 4A, the pre-determined range of offer amounts is from one to two-hundred.

In alternative embodiments of the present invention, the number of possible offers may be greater than, less than or equal to the number of possible selections for the player to select. In one embodiment, once an offer or symbol is associated with a selection, that offer or selection is not associated with another selection during a particular bonus round. In another embodiment, the same offer or symbol is associated with a plurality of selections in a particular bonus round.

In another embodiment, all of the associated offers and symbols are revealed on a separate display. In this embodiment, the current offer may be highlighted on the separate display. In an alternative embodiment, the maximum associated offer is separately displayed. In another embodiment, the minimum associated offer is separately displayed. In an alternative embodiment, an average of all the associated offers is separately displayed. In another embodiment, a plurality of random associated offers are separately displayed.

In one embodiment, upon triggering the bonus scheme the gaming device provides the player with a plurality of opportunities to select an offer. Each time the player chooses from the plurality of selections, the number of opportunities remaining to select an offer is reduced by one. The number of opportunities for the player to select an offer is preset or may be randomly determined. For increased entertainment, in another embodiment, the number of remaining opportunities in the bonus scheme may not be revealed to the player. In an alternative embodiment, the player does not have a plurality of opportunities to select an offer. In this embodiment, the bonus scheme ends when the player has either accepted an offer or a termination symbol is associated with a picked selection.

At least one terminator or termination symbol is associated with at least one selection. Alternatively, a plurality of termination symbols may be respectively associated with a plurality of selections. If a termination symbol is associated with the player selected selection, then the bonus scheme terminates and the game will provide the player no award, provide the player the last rejected award, provide the player a consolation award or provide the player with the award associated with the next selection. In another embodiment, if a termination symbol is associated with the player selected selection, then the bonus scheme ends and the game will provide the player a randomly selected award. In an alternative embodiment, if a termination symbol is associated with the player selected selection, the number of opportunities remaining to select an offer may be reduced by a preset or randomly determined amount.

In the primary embodiment of the present invention, at least one anti-terminator or anti-termination symbol is associated with at least one selection. If the player picks a selection that has an anti-termination symbol associated with it, the player retains the anti-termination symbol. In the event that in subsequent selections the player picks a selection that has a termination symbol associated with it, the retained anti-termination symbol is used to nullify the bonus scheme ending effect of the termination symbol. In an alternative embodiment, a plurality of anti-termination symbols may be respectively associated with a plurality of selections. In another embodiment, an anti-termination symbol may be used as a multiplier of the players next selected potential offer. In yet another embodiment, if an anti-termination symbol is associated with the player selected selection, then the player may be granted additional opportunities to obtain offers. It should be appreciated that the present invention's anti-terminator is player selectable from a plurality of selections. It should further be appreciated that the present invention's anti-terminator is preferably obtained during the bonus scheme of the present invention.

In one alternative embodiment of the present invention, one or more anti-terminators or anti-termination symbols may be obtained in the base game of the gaming device. These anti-terminators are retained by the processor of the gaming device. When a bonus game is initiated, the anti-terminators become available for use by the player in the bonus game. In one embodiment of the present invention, the anti-terminators are obtained in the base game and retained by the processor when, an anti-terminator symbol is displayed to the player, appears on a payline, appears on a winning payline, appears in combination with a winning combination, or appears in combination with a bonus triggering symbol or combination of symbols.

In another embodiment of the present invention, every time an offer associated with a player selected selection is at least a preset amount, the gaming device may recommend the player to accept said potential offer. For increased entertainment, the gaming device could recommend the player to accept an offer associated with a player selected selection before the offer has been revealed to the player.

Figure 3B:
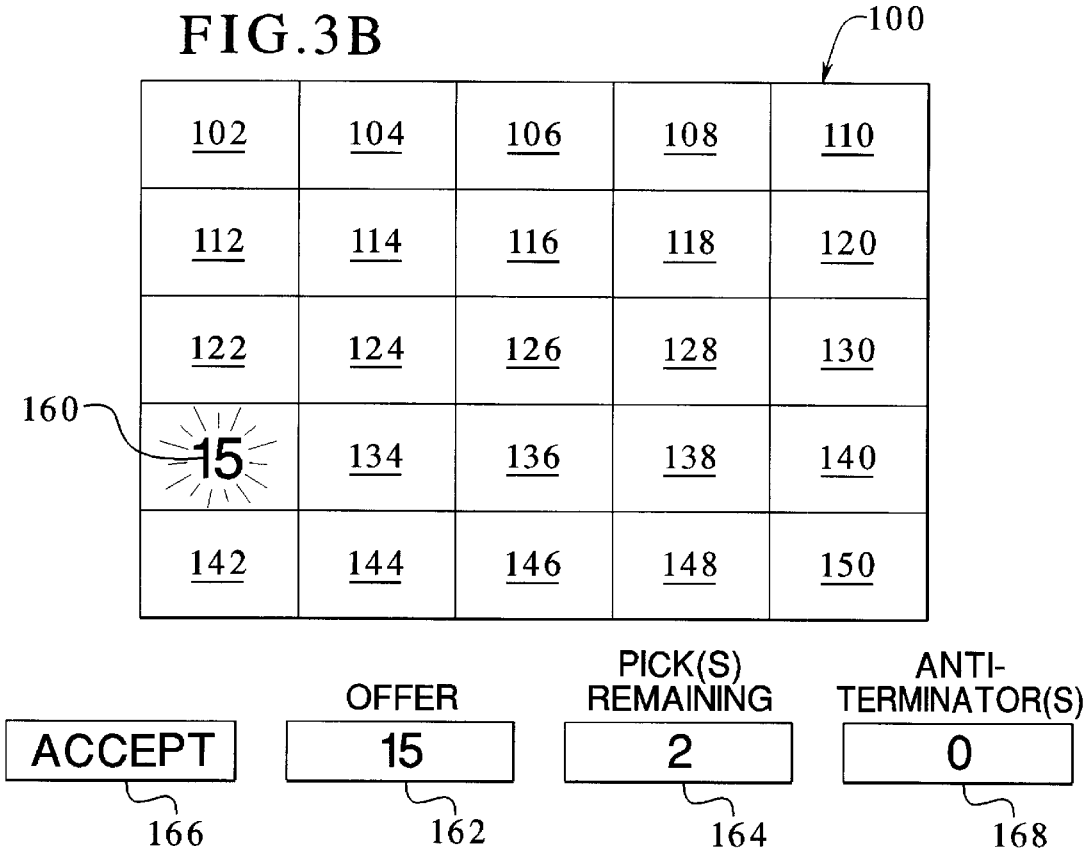
FIG. 3B is a front elevational view of the offer selection screen of one embodiment of the present invention illustrating a player picked offer revealed.

In one embodiment of the present invention, as further illustrated in FIG. 3B, the gaming device provides the player with an offer and acceptance display, which is preferably a touch screen which provides the player with the offer 162, the number of anti-terminators 168 the player has obtained and the number of remaining opportunities 164 the player has remaining in the bonus scheme. If the player has zero remaining opportunities to select a selection, then the player is awarded the last revealed offer. If the player has at least one remaining opportunities to select a selection, then the player may accept the revealed offer using an accept indicator 166 or select another selection. If the player accepts the revealed offer, the gaming device provides the player with the revealed offer, the player cannot obtain any more offers and the bonus scheme terminates. If the player selects another selection, then the previously revealed offer remains revealed and the player may not reselect that selection.

Referring now to FIGS. 3A to 3G, in one embodiment of the present invention, there are twenty-five selections 102 through 150, each with an offer or symbol associated with it. The player chooses one of the selections to obtain an offer or symbol. As illustrated in FIG. 3B, when the player makes a selection, the gaming device reveals the offer or symbol associated with the selected selection 160. In FIG. 3B, the player picks selection 132 which has an associated offer of fifteen credits. Appropriate messages such as "PICK A SELECTION TO OBTAIN AN OFFER" and "YOUR SELECTION HAS AN OFFER OF 15 CREDITS" are preferably provided to the player visually, or through suitable audio or audiovisual displays.

Figure 3C:
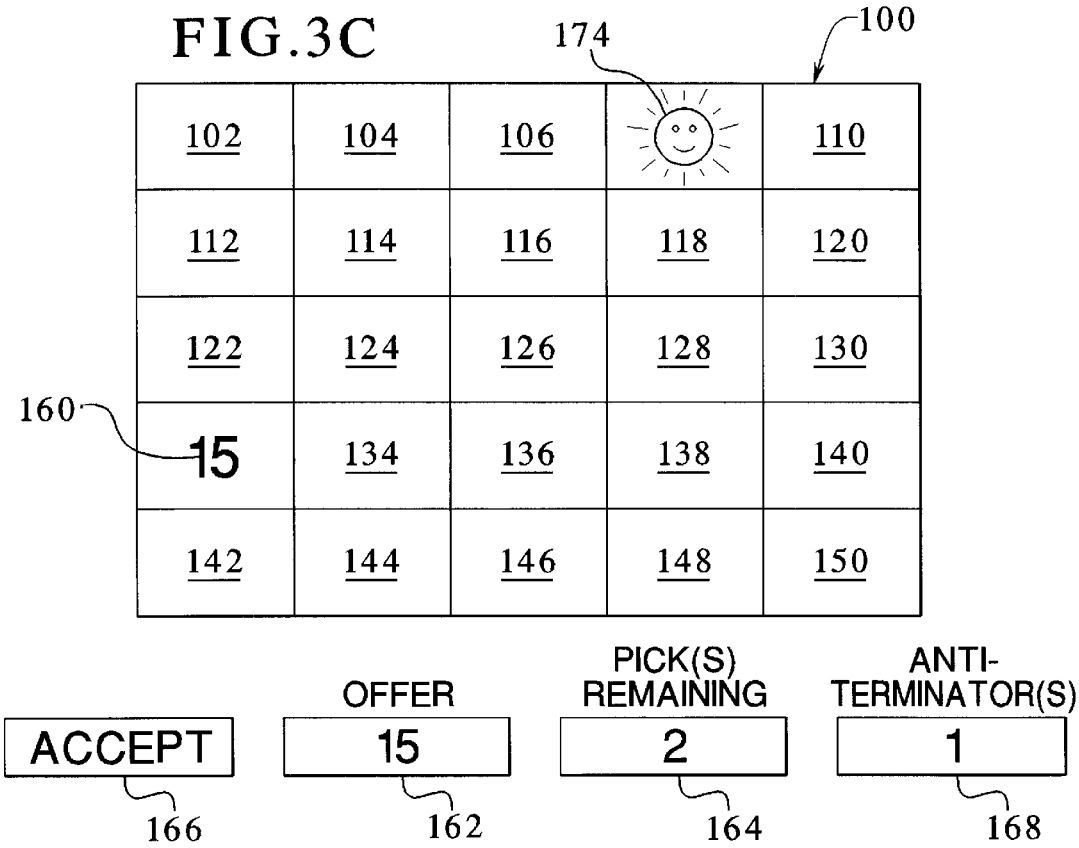
FIG. 3C is a front elevational view of the offer selection screen of one embodiment of the present invention illustrating a player picked anti-termination symbol revealed and retained.

As illustrated in FIG. 3C, the player chooses not to accept the offer of fifteen, and to pick another selection. The player's second pick is selection 108, which has an anti-termination symbol 174 associated with it. When an anti-termination symbol is revealed, in one embodiment the number of opportunities 164 to select a selection is not reduced. In an alternative embodiment, the number of opportunities to select a selection 164 may be reduced by one (or more) when an anti-termination symbol is revealed. Furthermore the offer 162 remains the last revealed offer.

Figure 3D:
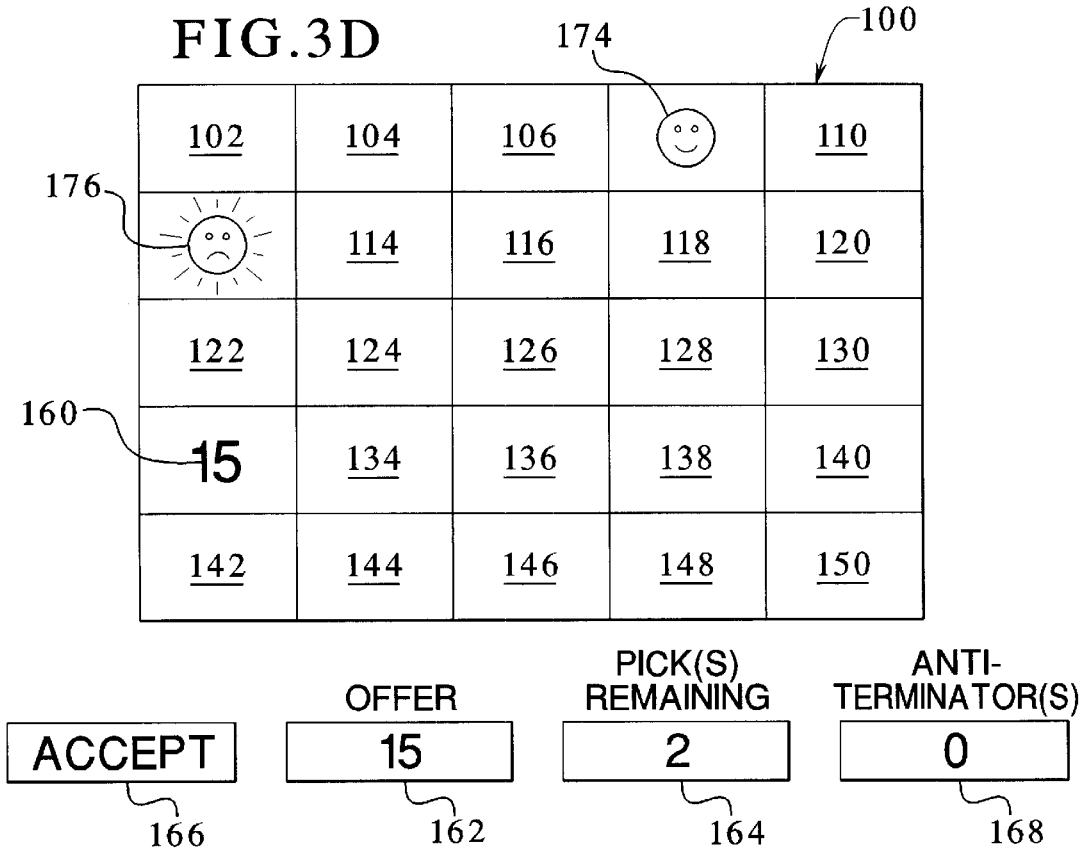
FIG. 3D is a front elevational view of the offer selection screen of one embodiment of the present invention illustrating a player picked termination symbol being nullified by a retained anti-termination symbol.

After obtaining an anti-termination symbol the player proceeds picking selections to reveal associated offers. As illustrated in FIG. 3D, the player's third pick is selection 112, which has a termination symbol 176 associated with it. In this case, the player's previously obtained anti-termination symbol is automatically used to nullify the termination symbol. In one embodiment, the number of opportunities to select a selection is not reduced when an anti-termination symbol nullifies a termination symbol. In an alternative embodiment, the number of opportunities to select a selection 164 may be reduced by one (or more) when an anti-termination symbol is used to nullify the effect of a termination symbol. The player's number of anti-terminators 168 is reduced by one each time an anti-termination symbol is used to nullify a termination symbol.

Figure 3E:
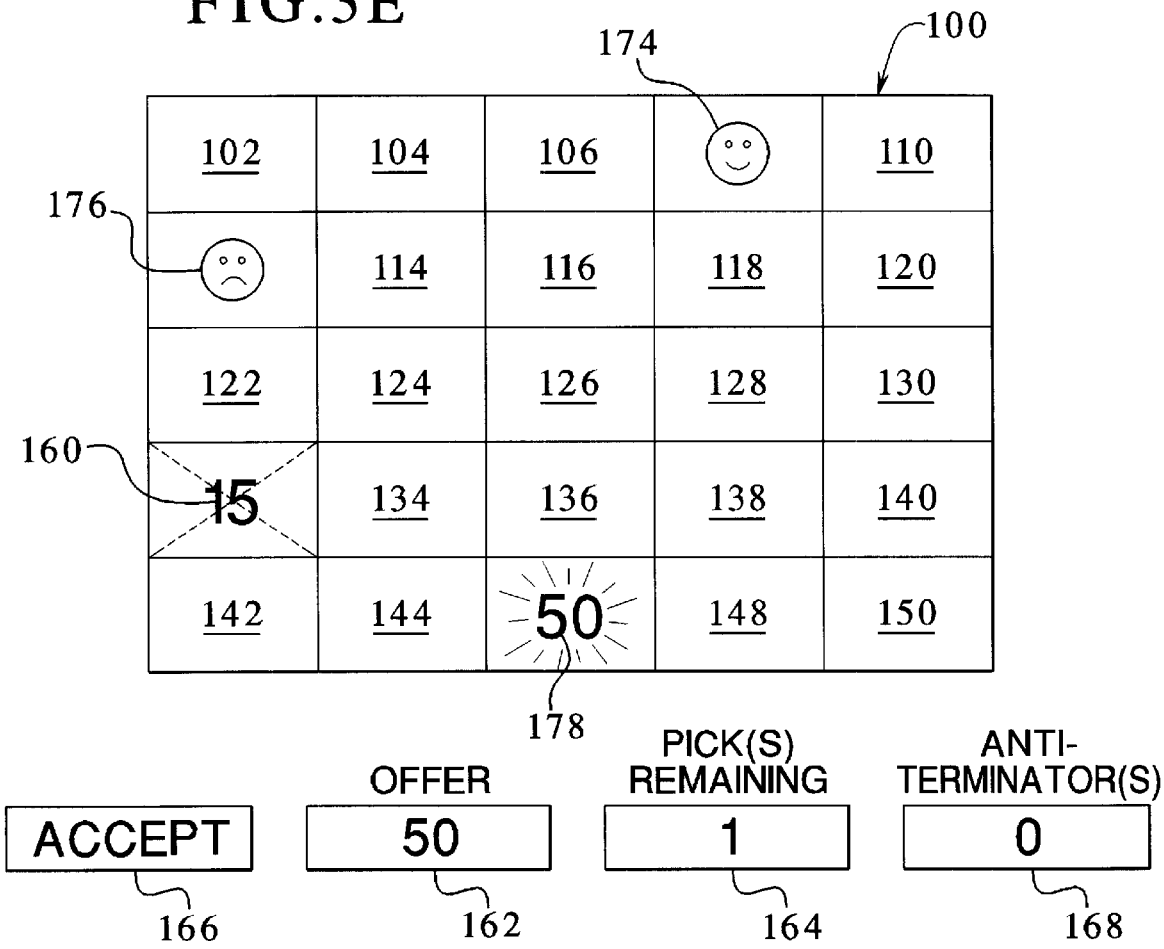
FIG. 3E is a front elevational view of the offer selection screen of one embodiment of the present invention illustrating a previously revealed offer remaining revealed and a subsequent player picked offer revealed.

As illustrated in FIG. 3E, the players fourth pick is selection 146 which has an offer of fifty credits associated with it. In this case, the previously picked selection and its revealed associated offer of fifteen remains revealed 160, and as indicated in phantom may not be selected by the player. Additionally, once the bonus scheme terminates, the gaming device may reveal all of the offers or symbols associated with the plurality of selections.

Figure 3F:
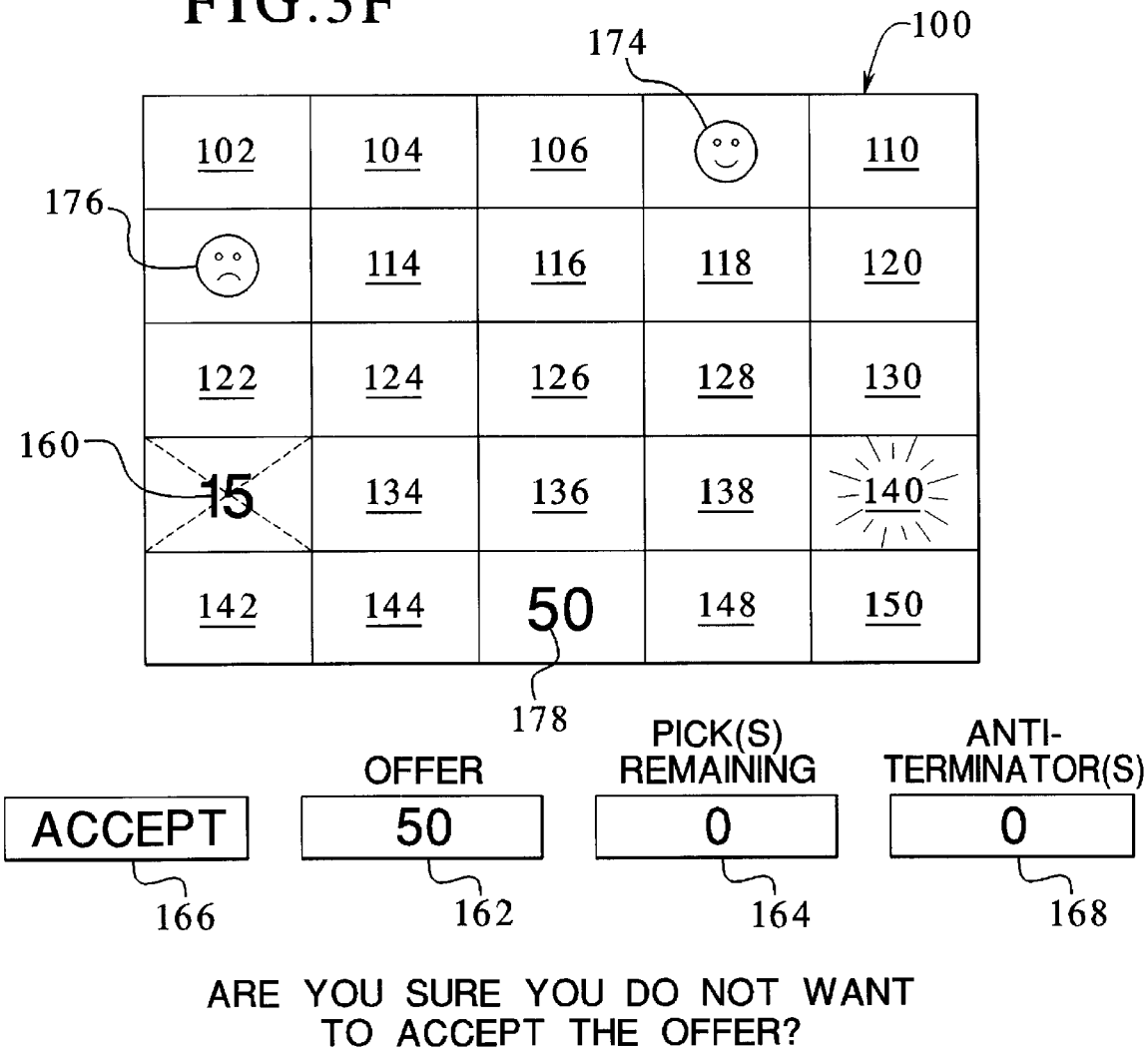
FIG. 3F is a front elevational view of the offer selection screen of one embodiment of the present invention illustrating the gaming device recommending that the player accept a previous offer prior to revealing an offer associated with another picked selection.
Figure 3G:
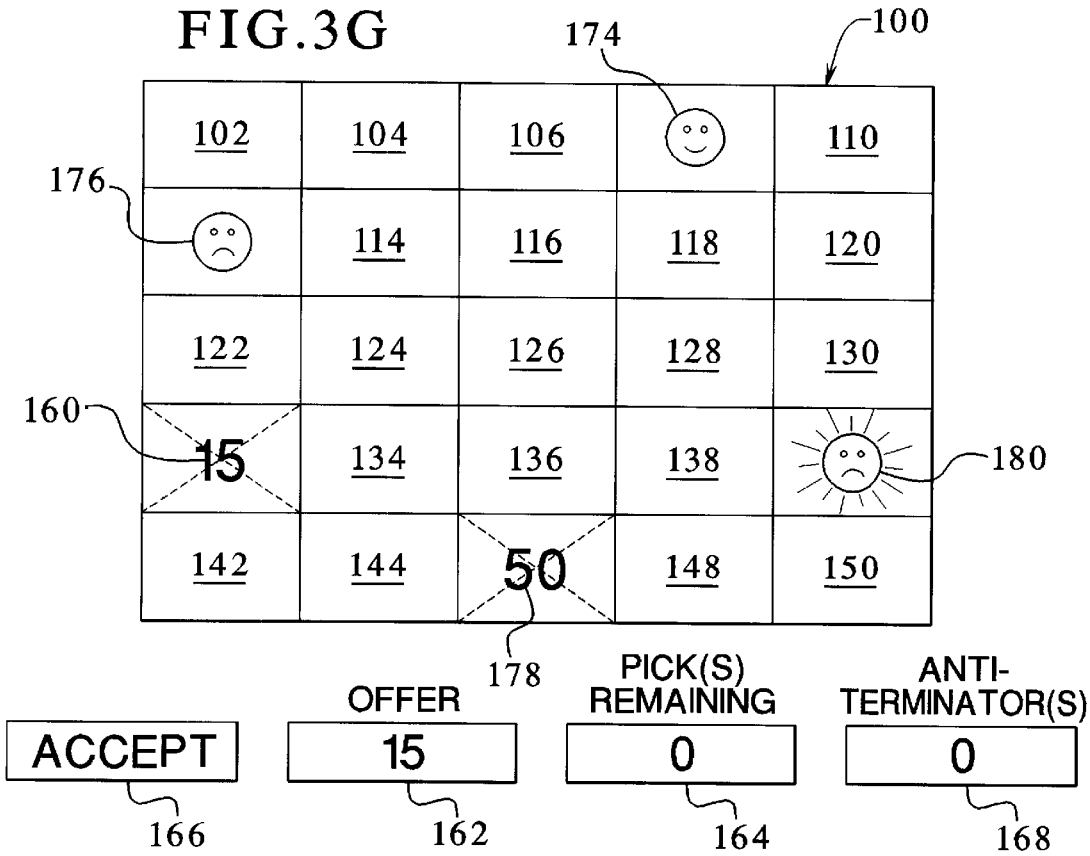
FIG. 3G is a front elevational view of the offer selection screen of one embodiment of the present invention illustrating a player picked terminator symbol terminating the bonus game.
Figure 3H:
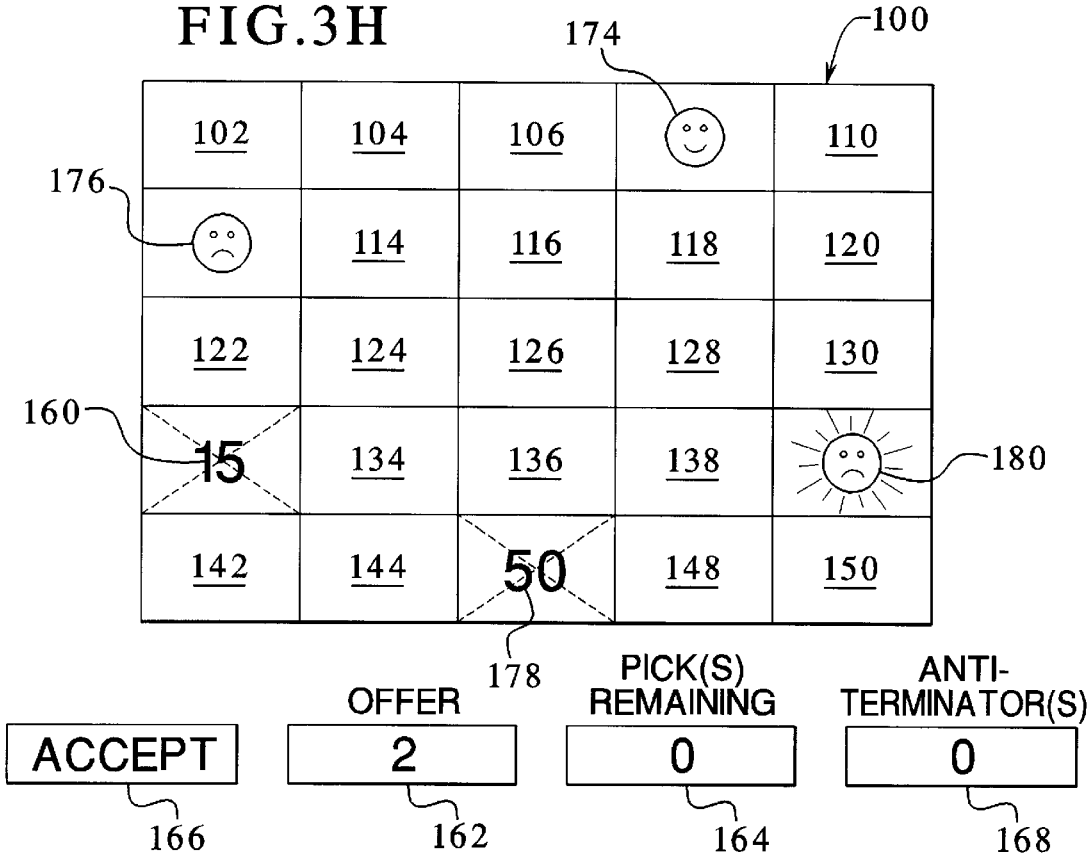
FIG. 3H is a front elevational view of the offer selection screen of one embodiment of the present invention illustrating a player provided a consolation award when a player picked terminator symbol terminates the bonus game.
Figure 3I:
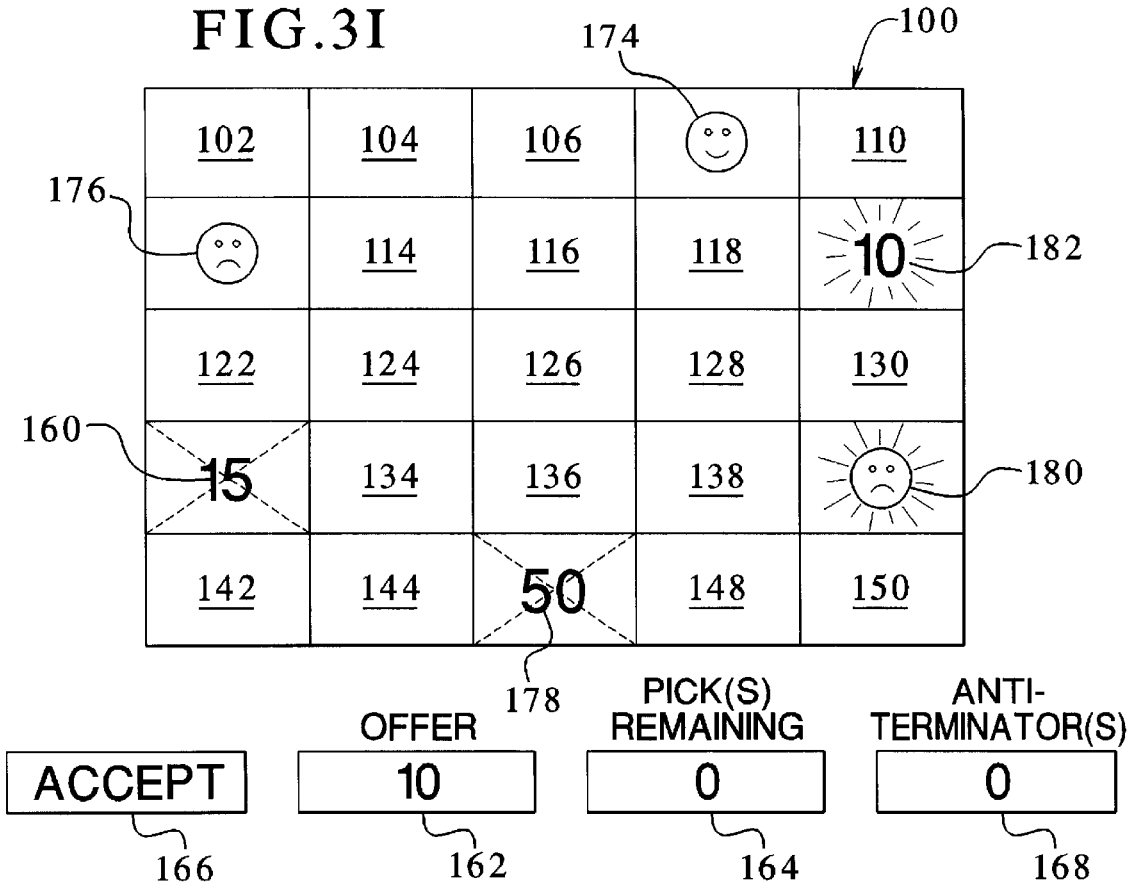
FIG. 3I is a front elevational view of the offer selection screen of one embodiment of the present invention illustrating a player provided a consolation award when a player picked terminator symbol terminates the bonus game.

As illustrated in FIG. 3F, if the player's fifth pick is highlighted selection 140, the gaming device recommends that the player accept the previous offer of fifty. Appropriate messages such as "ARE YOU SURE YOU DO NOT WANT TO ACCEPT THE OFFER?" are preferably provided to the player visually, or through suitable audio or audiovisual displays. As illustrated in FIG. 3G, if the player does not accept the previous offer, the gaming device reveals an associated termination symbol 180. As the player does not have a previously obtained anti-termination symbol, the bonus scheme ends. In this embodiment, the player would be awarded fifty credits (the player's last unaccepted offer) as their bonus award. In an alternative embodiment illustrated in FIG. 3H, the player is provided a consolation award of two credits. As seen in FIG. 3I, in another embodiment, the player is provided an award of ten credits 182 which is the offer associated with subsequent non-picked selection 120.

In one alternative embodiment of the present invention, if a retained anti-terminator is not employed to nullify a terminator or termination symbol before a player accepts an offer, the processor increases the award based on the number of anti-terminates retained by the processor when the player accepts an offer. The anti-terminator could provide a predetermined or randomly determined modification of the accepted offer for each retained anti-terminator. For instance, a multiplier or an additional award, value or number of credits could be associated with the anti-terminator or with each anti-terminator. The value or modifier associated with the anti-terminator could be applied by the processor in all instances or applied randomly. This increases the award offered to the player and cause the player to consider accepting each award if the player has obtained an anti-terminator.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a display device;

a plurality of player selectable selections displayed by the display device;

a plurality of offers associated with a plurality of said selections;

at least one terminator associated with one of said selections;

at least one anti-terminator associated with one of said selections;

a selector for enabling the player to pick the selections;

an offer acceptor for enabling the player to accept one of the offers associated with the selections picked by the player and made to the player; and a processor which communicates with the display device, the selector and the offer acceptor, randomly associates said offers with the selections, provides the player any offer associated with player picked selections, retains each anti-terminator associated with player picked selections, nullifies any terminator associated with a player picked selection by applying any retained anti-terminator to said terminator, causes the selector to enable the player to pick selections to be picked by the player until one of the selections having a terminator associated with said selection is picked and the processor does not have any retained anti-terminators or until the player accepts an offer.

2. The gaming device of claim 1, which includes a plurality of terminators associated with the selections, wherein each said terminator is associated with one of said selections.

3. The gaming device of claim 2, which includes a plurality of anti-terminators, wherein each said anti-terminator is associated with one of said plurality of selections.

4. The gaming device of claim 1, wherein a number of terminators associated with said selections is greater than a number of anti-terminators associated with said selections.

5. The gaming device of claim 1, wherein said display device displays a number of the anti-terminators which are associated with selections picked by the player.

6. The gaming device of claim 1, wherein the processor provides the player with a previous offer made to the player if the terminator is associated with the selection picked and the processor does not have a retained anti-terminator.

7. The gaming device of claim 1, wherein the processor provides the player with a consolation award if a terminator is associated with the selection picked and the processor does not have a retained anti-terminator.

8. The gaming device of claim 1, wherein the processor randomly selects said offers associated with the selection from a pool of offers.

9. The gaming device of claim 1, wherein the processor randomly selects said offers associated with the selections from a plurality of pools of offers.

10. The gaming device of claim 1, wherein the processor randomly selects said offers associated with the selections from a predetermined range of offers.

11. The gaming device of claim 1, wherein the number of offers is equal to the number of selections.

12. The gaming device of claim 1, wherein prior to revealing an offer associated with at least one of the selections, the display device displays a recommendation that the player accept a previous offer.

13. The gaming device of claim 1, wherein if one of the selections having a terminator associated with the selection is picked and the processor does not have any retained anti-terminators, the processor provides the player an award which is selected from the group consisting of: a previous offer; a consolation award, and an award associated with a subsequent selection.

14. The gaming device of claim 1, wherein if any anti-terminator is retained by the processor when the player accepts an offer, the processor applies a modifier associated with said terminator to the accepted offer.

15. The gaming device of claim 14, wherein the modifier is a multiplier of the accepted offer.

16. The gaming device of claim 1, wherein if any anti-terminator is retained by the processor when the player accepts an offer, the processor randomly determines whether to apply a modifier associated with said terminator to the accepted offer.

17. The gaming device of claim 16, wherein the modifier is a multiplier of the accepted offer.

18. A gaming device comprising:

a display device;

a plurality of player selectable selections displayed by the display device;

a plurality of offers associated with a plurality of said selections;

a plurality of terminators associated with a plurality of said selections;

a plurality of anti-terminators associated with a plurality of said selections;

a selector for enabling the player to pick the selections;

an offer acceptor for enabling the player to accept one of the offers associated with the selections picked by the player and made to the player; and a processor which communicates with the display device, the selector and the offer acceptor, which randomly associates said offers with the selections, provides the player any award associated with selections picked by the player, retains each anti-terminator associated with selections picked by the player until the player picks one of the selections having the terminator, causes the selector to enable the player to pick selections until the player accepts an offer or until the player picks one of the selections having a terminator associated with said selection and the processor does not have any retained anti-terminators.

19. The gaming device of claim 18, wherein a number of terminators associated with said selections is greater than a number of anti-terminators associated with said selections.

20. The gaming device of claim 18, wherein said display device displays a number of the anti-terminators which are associated with selections picked by the player.

21. The gaming device of claim 18, wherein the processor provides the player with the offer if the terminator is associated with the selection picked by the player and the processor does not have a retained anti-terminator.

22. The gaming device of claim 18, wherein the processor provides the player with a consolation award if a terminator is associated with the selection picked by the player and the processor does not have a retained anti-terminator.

23. The gaming device of claim 18, wherein the processor randomly selects said offers associated with the selection from a pool of offers.

24. The gaming device of claim 18, wherein the processor randomly selects said offers associated with the selections from a plurality of pools of offers.

25. The gaming device of claim 18, wherein the processor randomly selects said offers associated with the selections from a predetermined range of offers.

26. The gaming device of claim 18, wherein the number of offers is equal to the number of selections.

27. The gaming device of claim 18, wherein prior to revealing an offer associated with at least one of the selections, the display device displays a recommendation that the player accept a previous offer.

28. A gaming device comprising:

a display device;

a plurality of selections displayed by the display device;

a plurality of offers associated with said selections;

a number of player picks of said selections;

at least one terminator associated with one of said selections;

at least one anti-terminator associated with one of said selections;

a selector for enabling the player to pick the selections;

an offer acceptor for enabling the player to accept one of the offers associated with the selections picked by the player and made to the player; and a processor which communicates with the display device, the selector and the offer acceptor, which randomly associates said offers with the selections, provides the player any award associated with selections picked by the player, retains the anti-terminators associated with selections picked by the player until the player picks one of the selections having the terminator, causes the selector to enable the player to pick selections until the player accepts an offer, uses all of the players picks of selections or until the player picks one of the selections having a terminator associated with said selection and the processor does not have any retained anti-terminators.

29. The gaming device of claim 28, wherein the plurality of player picks is increased by at least one if the player picks a selection having an anti-terminator associated with said selection.

30. The gaming device of claim 28, wherein said number of player picks of said plurality of selections is at least in part randomly determined.

31. The gaming device of claim 28, wherein said number of player picks of said plurality of selections is predetermined.

32. The gaming device of claim 28, wherein said display device displays the number of player picks.

33. A gaming device having a bonus game comprising:

a plurality of selections;

a plurality of offers associated with said plurality of selections;

a plurality of player picks of said selections;

at least one terminator associated with one of said plurality of selections;

at least one anti-terminator associated with one of said plurality of selections;

a display device; and a processor which communicates with said display device, wherein said processor and said display device are adapted to:

(a) enable a player to pick one of said selections;

(b) reveal the offer, anti-terminator or terminator associated with the picked selection to the player;

(c) accumulate any revealed anti-terminators;

(d) perform a terminating event if a terminator is revealed and the processor does not have any accumulated anti-terminators;

(e) apply an accumulated anti-terminator to continue the bonus game if a terminator is revealed;

(f) enable the player to accept the revealed offer or select another selection if there are unpicked selections and the terminating event is not performed;

(g) repeat steps (b) to (f) at least once if said player does not accept said revealed offer or if the terminating event is not performed.

34. The gaming device of claim 33, which includes a plurality of terminators associated with said selections.

35. The gaming device of claim 33, which includes an award modifier associated with said anti-terminator, wherein the processor applies the award modifier to an offer accepted by the player if the player accepts an award when the processor has an accumulated anti-terminator.

36. The gaming device of claim 35, wherein the award modifier includes a multiplier of the accepted offer.

* * * * *

UNITED STATES PATENT AND TRADEMARK OFFICE

CERTIFICATE OF CORRECTION

PATENT NO. : 6,632,141 B2
DATED : October 14, 2003
INVENTOR(S) : Bayard S. Webb et al.

It is certified that error appears in the above-identified patent and that said Letters Patent is hereby corrected as shown below:

Title page, Item [54] and Column 1, lines 1-4,
Title, change "GAMING DEVICE HAVING AN OFFER AND ACCEPTANCE SELECTION BONUS SCHEME WITH A TERMINATOR AND AN ANTI-TERMINATOR" to -- GAMING DEVICE HAVING AN OFFER AND ACCEPTANCE SELECTION BONUS SCHEME WITH A TERMINATOR AND AN ANTI-TERMINATIOR --.

Column 1,
Line 49, change "DEVICE HAVING" to -- DEVICE HAVING IMPROVED OFFER AND ACCEPTANCE BONUS SCHEME, "Serial No. 10/074,273 --.

Column 5,
Line 45, change "farther" to -- further --.

Column 8,
Line 31, change "opportunities" to -- opportunity --.

Column 10,
Line 24, change "each said terminator" to -- each of said terminators --.
Line 27, change "each said" to -- each of said --.
Line 28, change "terminator" to -- terminators --.

Signed and Sealed this

Thirteenth Day of April, 2004

JON W. DUDAS
*Acting Director of the United States Patent and Trademark Office*